US009595748B2

(12) United States Patent
Hiller

(10) Patent No.: US 9,595,748 B2
(45) Date of Patent: Mar. 14, 2017

(54) REMOTELY DEPLOYABLE, UNMANNED SATELLITE ANTENNA

(71) Applicant: The Boeing Company, Chicago, IL (US)

(72) Inventor: Nathan D. Hiller, Irvine, CA (US)

(73) Assignee: The Boeing Company, Chicago, IL (US)

( * ) Notice: Subject to any disclaimer, the term of this patent is extended or adjusted under 35 U.S.C. 154(b) by 364 days.

(21) Appl. No.: 14/327,260

(22) Filed: Jul. 9, 2014

(65) Prior Publication Data

US 2016/0013542 A1 Jan. 14, 2016

(51) Int. Cl.
*H01Q 1/00* (2006.01)
*H01Q 1/08* (2006.01)
*H01Q 1/28* (2006.01)

(52) U.S. Cl.
CPC ..... *H01Q 1/005* (2013.01); *H01Q 1/081* (2013.01); *H01Q 1/288* (2013.01)

(58) Field of Classification Search
CPC ..... H01Q 1/005; H01Q 1/081; H01Q 1/288
USPC ..... 343/702
See application file for complete search history.

(56) References Cited

U.S. PATENT DOCUMENTS 3,115,631 A * 12/1963 Erhard ..... H01Q 1/081 342/8
7,133,001 B2 * 11/2006 Mrstik ..... H01Q 1/082 342/10

OTHER PUBLICATIONS

Daniel R. Altschuler, The National Astronomy and Ionosphere Center's (NAIC) Arecibo Observatory in Puerto Rico, Astronomical Society of the Pacific, provided by the NASA Astrophysics Data System, 2002.
Per-Simon Kildal, Synthesis of Multireflector Antennas by Kinematic and Dynamic Ray Tracing, IEEE Transactions on Antennas and Propagation, vol. 38, No. 10, Oct. 1990.
Harry R. Anderson, Fixed wireless antenna systems, 2003 John Wiley & Sons, Ltd.
Jerome A Hudson, Richard Plambeck and William J. Welch, Aperture efficiency enhancement in a Cassegrain system by means of a dielectric lens, Radio Astronomy Laboratory, University of California at Berkeley, Radio Science, vol. 22, No. 6, pp. 1091-1101, Nov. 1987.
www.gatr.com/media-section/news/item/gatr-awarded-440m-contract-with-u-s-army . . . GATR awarded $440M contract with U.S. Army PM Win-T, 2016.

* cited by examiner

*Primary Examiner* — Dameon E Levi
*Assistant Examiner* — Walter Davis
(74) *Attorney, Agent, or Firm* — Joseph M. Rolnicki; Evans & Dixon, L.L.C.

(57) ABSTRACT

A remotely deployable, unmanned, inflatable satellite antenna is provided with shock absorbing supports inside a body of the antenna. The shock absorbing supports operatively connect the satellite receiver to the body interior surface and support the satellite receiver inside the body interior while allowing limited movement of the satellite receiver relative to the body interior surface in response to a shock force exerted on the body exterior surface when the antenna is deployed by air drop and impacts with the ground.

20 Claims, 4 Drawing Sheets

REMOTELY DEPLOYABLE, UNMANNED SATELLITE ANTENNA

FIELD

The field of this disclosure is satellite antennas. More particularly, the field of this disclosure is an inflatable satellite antenna that is remotely deployable.

BACKGROUND

Transportable, inflatable antennas have been in use for many years. The typical antenna includes an inflatable sphere that contains the dish of the antenna and supports the feeder horn of the antenna.

The inflatable antenna can be deflated for transportation. The reduced size of the deflated antenna makes it easy to transport to a desired location. At the desired location the antenna is then inflated by one or more operator personnel. The dish and horn of the antenna are connected to the control electronics by the personnel. The antenna is then positioned for operation and secured in place on the ground by the personnel.

Inflatable antennas of the type described above require one or more personnel for their set up at the desired ground location.

SUMMARY

The remotely deployable, unmanned, satellite antenna of this disclosure is an improvement over prior portable, inflatable antennas in that it does not require personnel for its set up and orientation on the ground.

The remotely deployable, unmanned, satellite antenna of this disclosure comprises a body having a spherical exterior surface and a spherical interior surface that surrounds a hollow interior of the antenna. The antenna body is collapsible to a collapsed configuration for transportation, and inflatable to expand to its spherical configuration for deployment.

A satellite receiver is provided inside the body interior.

A rotation device is also provided inside the body interior. The rotation device is operatively connected to the satellite receiver and is operable to rotate the satellite receiver about first and second mutually perpendicular axes inside the body interior to properly orient the receiver in the deployed antenna.

An energy source is also provided inside the body interior. The energy source is operatively connected to the satellite receiver and the rotation device to supply electric energy to the receiver and device.

Shock absorbing supports are provided inside the body interior. The shock absorbing supports operatively connect the satellite receiver, the rotation device and the energy source to the body interior surface. The shock absorbing supports support the satellite receiver, the rotation device and the energy source inside the body interior while allowing limited movement of the satellite receiver, rotation device and energy source relative to the body interior surface in response to a shock force exerted on the body exterior surface. The shock absorbing supports enable the satellite antenna to be air droppable to a desired ground location. The shock absorbing supports shield the satellite receiver, the rotation device and the energy source inside the body interior when the body exterior surface impacts with the ground from the air dropped deployment.

In one embodiment of the remotely deployable, unmanned satellite antenna the satellite receiver comprises a dual reflector feed inside the body interior. The dual reflector feed minimizes the effects of phase aberrations and "spreading" of the focal point due to the spherical reflector.

In another embodiment the phase aberrations and "spreading" of the focal point are minimized by the feed of the satellite receiver with a dielectric lens.

The body of the satellite antenna can also have at least a portion constructed as wave partially reflecting and partially transmitting.

In addition to the energy source inside the antenna body, a solar cell outside the body can be communicated with the satellite receiver. The solar cell can be a flexible, lightweight, impact resistant solar cell sheet that can be located outside the body and attached to the body using a flexible cord. Alternatively, thin solar cells can be deposited or attached to the body interior surface.

The elements of the satellite antenna of this disclosure discussed above enable the satellite antenna to be remotely deployable and unmanned.

The features, functions, and advantages that have been discussed can be achieved independently in various embodiments or may be combined in yet other embodiments further details of which can be seen with reference to the following description and drawings.

BRIEF DESCRIPTION OF THE DRAWINGS

Further features of the remotely deployable, unmanned, satellite antenna of this disclosure are set forth in the detailed description of the antenna and in the drawing figures.

Each figure shown in this disclosure shows a variation of an aspect of the embodiments presented, and only differences will be discussed in detail.

DETAILED DESCRIPTION

Figure 1:
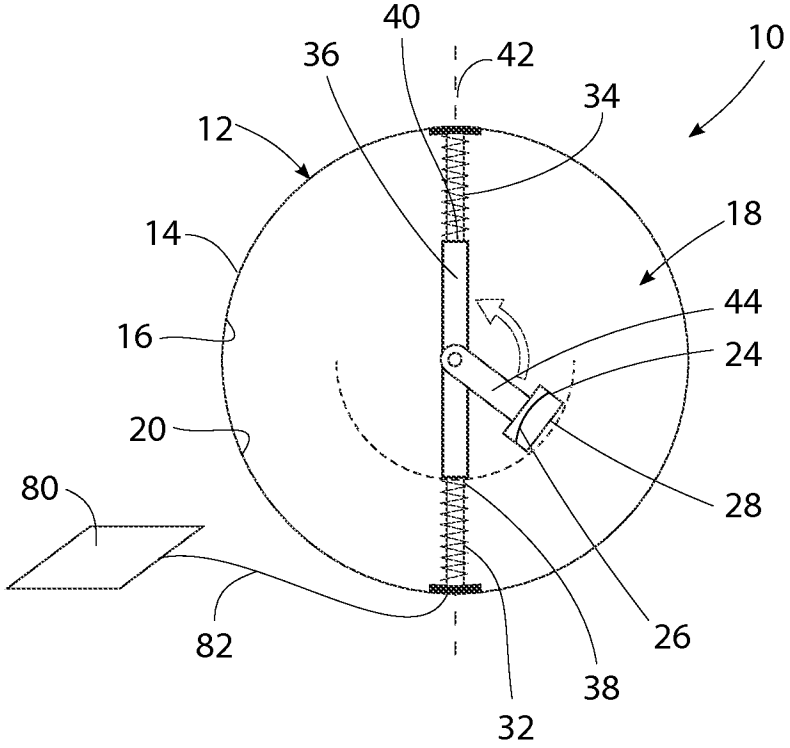
FIG. 1 is a representation of a sectioned view of the satellite antenna in its expanded, spherical configuration.

FIG. 1 is a representation of a cross section of the remotely deployable, unmanned, satellite antenna 10 of this disclosure showing the internal components of the antenna. The antenna 10 is an inflatable antenna having a spherical body 12 with a spherical exterior surface 14 and a spherical interior surface 16 when inflated. The spherical interior surface 16 surrounds a hollow interior 18 of the body and the other components of the satellite antenna to be described. As with all inflatable satellite antennas, the antenna body 12 is collapsible to a collapsed configuration for transportation, and is inflated and expanded to its spherical configuration represented in FIG. 1 for deployment. The body 12 is constructed of materials typically employed in constructing inflatable satellite antennas. The body could be partially wave reflective and partially wave transparent. When expanded, the body 12 has approximately a three meter diameter dimension. However, the body 12 could have other dimensions. A portion 20 of the body interior surface 16 functions as the reflector surface of the antenna. In the representation of the antenna 10 shown in FIG. 1, the bottom half of the body interior surface 16 functions as the reflector surface.

A satellite receiver 24 is provided inside the body interior 18. In order to minimize some phase aberrations and "spreading" of the focal point introduced by the spherical reflector surface 20, the satellite receiver 24 could comprise a dual reflector feed represented by the second curved surface 26 on the receiver. Alternatively, the satellite receiver 24 could comprise a dielectric lens. The dielectric lens could be constructed from polytetrafluoroethylene (Teflon®), fused quartz, cross-linked polystyrene, foams, or other low-loss dielectric material.

The satellite receiver 24 is operatively connected to the body interior surface 16 by a tubular shock absorbing first support 32 and a tubular shock absorbing second support 34. The shock absorbing first support 32 and second support 34 support the satellite receiver 24 inside the body interior 18 while allowing limited movement of the satellite receiver relative to the body interior surface 16 in response to a shock force exerted on the body exterior surface 14. A tubular housing 36 having opposite first 38 and second 40 ends connects the shock absorbing first support 32 and the shock absorbing second support 34. The tubular housing 36 is cylindrical and has a center, first axis 42. The shock absorbing first support 32 and the shock absorbing second support 34 are coaxial and have a common center axis with the tubular housing center axis 42. The housing 36 is operatively connected to the satellite receiver 24 through a bracket 44 that is mounted to the housing 36 by a pivot connection 46. The pivot connection 46 enables the bracket 44 to pivot about a second axis 48 that is mutually perpendicular with the first center, first axis 42 of the tubular housing 36.

Figure 3:
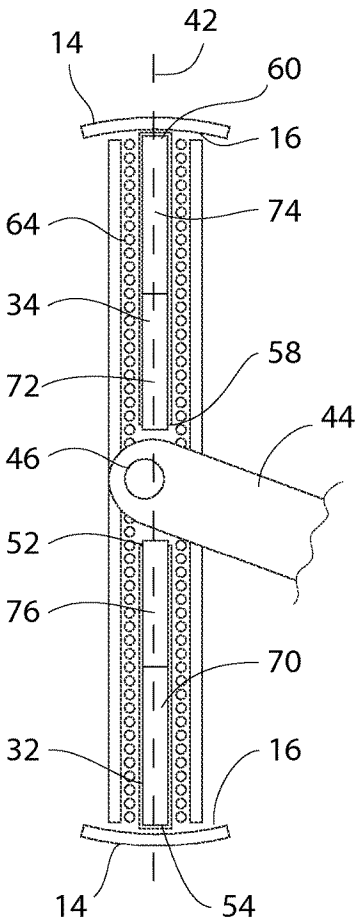
FIG. 3 is a representation of a partial view of the satellite antenna in its collapsed configuration.
Figure 4:
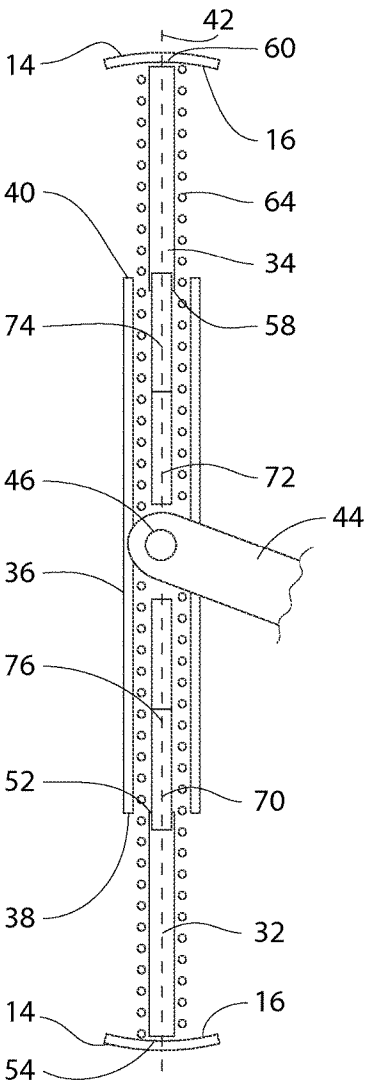
FIG. 4 is a representation of a partial view of the satellite antenna in its expanded, spherical configuration.

Referring to FIGS. 3 and 4, the shock absorbing first support 32 has a tubular length with opposite proximal 52 and distal 54 ends. The first support proximal end 52 is received in the tubular housing first end 38 for reciprocating movement of the first support 32 relative to the housing 36. The first support 32 is moveable relative to the tubular housing 36 and the satellite receiver 24 between a retracted position represented in FIG. 3, and an extended position represented in FIG. 4. In the retracted position of the shock absorbing first support 32 the shock absorbing first support distal end 54 is in close proximity to the receiver 24. In the extended position of the shock absorbing first support 32 relative to the satellite receiver 24 the shock absorbing first support distal end 54 is displaced from the satellite receiver 24. The shock absorbing first support distal end 54 is attached to the body interior surface 16, thereby operatively connecting the satellite receiver 24 to the body interior surface 16.

The shock absorbing second support 34 has basically the same construction as the first support 32. The shock absorbing second support also has a tubular length with opposite proximal 58 and distal 60 ends. The second support proximal end 58 is received in the tubular housing second end 40 for reciprocating movement of the second support 34 relative to the housing 36. The shock absorbing second support 34 is moveable relative to the tubular housing 36 and the satellite receiver 24 between a retracted position of the shock absorbing second support 34 represented in FIG. 3, and an extended position of the shock absorbing second support 34 represented in FIG. 4. In the retracted position of the shock absorbing second support 34 the shock absorbing second support distal end 60 is in close proximity to the satellite receiver 24. In the extended position of the shock absorbing second support 34 the shock absorbing second support distal end 60 is displaced from the satellite receiver 24. The shock absorbing second support distal end 60 is attached to the body interior surface 16, thereby operatively connecting the satellite receiver 24 to the body interior surface 16.

The shock absorbing first support 32 and the shock absorbing second support 34 are in their retracted positions relative to the housing 36 and the satellite receiver 24 represented in FIG. 3 when the antenna body 12 is collapsed to its collapsed configuration for transportation of the antenna 10. The shock absorbing first support 32 and the shock absorbing second support 34 are in their extended positions relative to the housing 36 and the satellite antenna 24 represented in FIG. 4 when the antenna body 12 is expanded to its spherical configuration for deployment.

A spring device 64 biases the shock absorbing first support 32 and the shock absorbing second support 34 to their extended positions represented in FIG. 4. In the embodiment of the antenna 10 shown in the drawing figures, the spring device 64 is a single coil spring that extends through the tubular housing 36 and across the exteriors of the shock absorbing first support 32 and the shock absorbing second support 34 and is secured to the respective distal ends 54, 60 of the supports. Other equivalent types of springs could be employed as the spring device 64. For example, the spring device 64 could be comprised of two separate coils springs. When the antenna body 12 is collapsed to its collapsed configuration, the spring device 64 is compressed into the tubular housing 36 as represented in FIG. 3. With the spring device 64 compressed, latching devices (not shown) are provided at the opposite ends of the tubular housing 36 to hold the spring device 64 in its compressed condition. When expanding the antenna body 12 to its spherical configuration, the latching devices are released allowing the spring device 64 to bias the shock absorbing first support 32 and the shock absorbing second support 34 to their extended positions from the opposite ends of the housing 36. When the shock absorbing first support 32 and the shock absorbing second support 34 are biased to their extended positions by the spring device as represented in FIG. 4, any impact of the body exterior surface 14 will be resisted by the spring device 64 and the shock of the impact will be absorbed by the spring device 64.

A first rotation device 70, for example an electric motor is positioned in the tubular housing 36 and the tubular first support 32. The first rotation device 70 is operatively connected between the shock absorbing first support 32 and the tubular housing 36. Operation of the first rotation device 70 selectively rotates the tubular housing 36 about the first axis 42 and thereby rotates the satellite receiver 24 in a circle around the first axis 42 inside the antenna body interior 18. This enables adjusting the position of the satellite receiver 24 around the center of the reflective surface portion 20 of the body interior surface 16. This in turn enables adjustment of the position of the satellite receiver 24 relative to the reflective surface 20 once the antenna 10 has been deployed.

A second rotation device 72 is positioned in the tubular housing 36 and the tubular second support 34. The second rotation device 72 is operatively connected between the tubular housing 36 and the pivot connection 46 of the bracket 44 to the housing. Selective operation of the second rotation device 72 pivots the bracket 44 on the housing 36 about the second axis 48 and causes the satellite receiver 24 to move in an arc relative to the reflective surface portion 20 of the body interior surface 16. This movement of the satellite receiver 24 about the second axis 48 also enables adjusting the position of the receiver relative to the reflector surface position 20 after the antenna 10 has been deployed.

Control electronics 74 for the satellite antenna 10 are positioned in the tubular housing 36 and in the tubular shock absorbing second support 34. The control electronics 74 are connected in communication with the satellite receiver 24, the latch devices (not shown), the first rotation device 70 and the second rotation device 72. The control electronics 74 include software to operate the satellite receiver 24, the latch devices (not shown), the first rotation device 70 and the second rotation device 72.

An energy source 76, such as a battery is positioned in the tubular housing 36 and the tubular first support 32. The energy source 76 is operatively connected to the satellite receiver 24, the latch devices (not shown), the first rotation device 70, the second rotation device 72 and the control electronics 74. The energy source 76 provides electric energy to the satellite receiver 24, the latch mechanisms (not shown), the first rotation device 70, the second rotation device 72 and the control electronics 74 when the satellite 10 is deployed to enable operation of all the satellite components.

Additionally, a further energy source such as solar cells could be provided on the body interior surface 16 or could be provided outside the body 12. For example, a blanket 80 of solar cells represented in FIG. 1 could be provided outside the antenna body 12 and communicating through electrical wiring 82 with the control electronics 74 and the energy source 76 inside the tubular housing 36. The control electronics 84 would be powered by the solar blanket 80 in addition to the energy source 76 inside the antenna 10.

Figure 2:
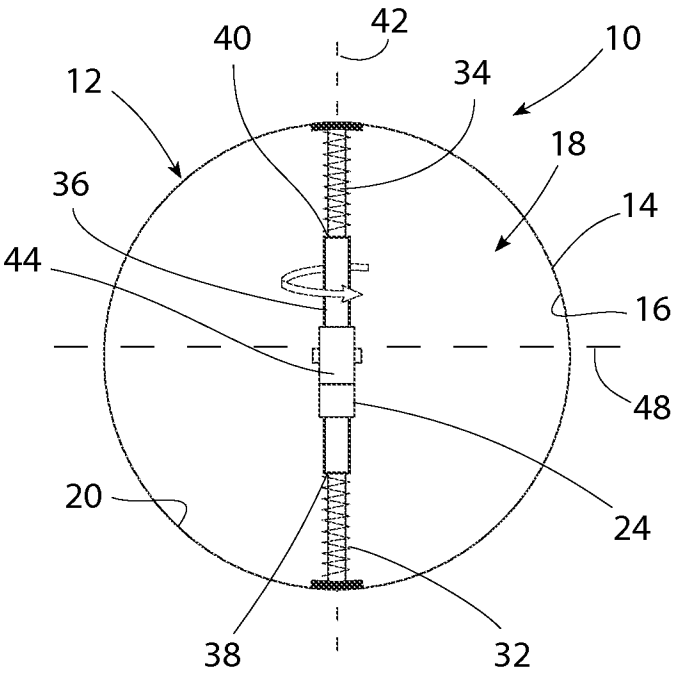
FIG. 2 is a representation of the satellite antenna similar to FIG. 1 but rotated 90 degrees to the left.

Thus, the shock absorbing first support 32 and shock absorbing second support 34 support the satellite receiver 24, the first 70 and second 72 rotation devices, the energy source 76 and the control electronics 74 inside the body interior 18 while allowing limited movement of the satellite receiver 24, the rotation devices 70, 72, the energy source 76 and the control electronics 74 relative to the body interior surface 16 in response to a shock force exerted on the body exterior surface 14. The shock absorbing first support 32 and second support 34 enable the satellite antenna 10 to be air droppable to a desired ground location. Shock absorbing first support 32 and shock absorbing second support 34 shield the satellite receiver 24, the rotation devices 70, 72, the energy source 76 and the control electronics 74 inside the body interior 18 when the body exterior surface 14 impacts with the ground from the air dropped deployment. The antenna is weighted so that it will orient itself as shown in FIGS. 1 and 2 when air dropped so that the shock absorbing first support 32 and shock absorbing second support 34 will absorb the force of impact.

The elements of the satellite antenna 10 of this disclosure discussed above enable the satellite antenna 10 to be remotely deployable and unmanned.

As various modifications could be made in the construction of the apparatus and its method of operation herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

The invention claimed is:

1. A remotely deployable, unmanned, satellite antenna, comprising:

a body having a spherical exterior surface and a spherical interior surface, the spherical interior surface surrounding a hollow interior of the body comprising a body interior;

a satellite receiver inside the body interior; and, shock absorbing supports inside the body interior, the shock absorbing supports operatively connecting the satellite receiver to the body interior surface and supporting the satellite receiver inside the body interior while allowing limited movement of the satellite receiver relative to a body interior surface in response to a shock force exerted on a body exterior surface.

2. The satellite antenna of claim 1, further comprising:

the satellite receiver being rotatable about mutually perpendicular first and second axes inside the body interior.

3. The satellite antenna of claim 1, further comprising:

at least a portion of the body being constructed as wave partially reflecting and wave partially transmitting.

4. The satellite antenna of claim 1, further comprising:

the satellite antenna being air droppable.

5. The satellite antenna of claim 1, further comprising:

a solar cell electrically connected with the satellite receiver.

6. The satellite antenna of claim 1, further comprising:

a rotation device inside the body interior, the rotation device being operably connected to the satellite receiver and being operable to rotate the satellite receiver about first and second mutually perpendicular axes inside the body interior; and, the shock absorbing supports operatively connecting the rotation device to the body interior surface and supporting the rotation device inside the body interior while allowing limited movement of the rotation device relative to the body interior surface in response to a shock force exerted on the body exterior surface.

7. The satellite antenna of claim 1, further comprising:

an energy source inside the body interior, the energy source being operably connected to the satellite receiver and being operable to supply electric energy to the satellite receiver; and, the shock absorbing supports operatively connecting the energy source to the body interior surface and supporting the energy source inside the body interior while allowing limited movement of the energy source relative to the body interior surface in response to a shock force exerted on the body exterior surface.

8. A remotely deployable, unmanned satellite antenna, comprising:

a body having a spherical exterior surface and a spherical interior surface, the body being collapsible to a collapsed configuration for transportation and expandable to a spherical configuration for deployment, the spherical interior surface of the body surrounding a hollow interior of the body comprising a body interior;

a satellite receiver inside the body interior;

a shock absorbing first support inside the body interior, the shock absorbing first support being operatively connected to the satellite receiver, the shock absorbing first support having a length with opposite proximal and distal ends, the shock absorbing first support being moveable between a retracted position of the shock absorbing first support relative to the satellite receiver where the shock absorbing first support distal end is in close proximity to the receiver and an extended position of the shock absorbing first support relative to the satellite receiver where the shock absorbing first support distal end is displaced from the satellite receiver, the shock absorbing first support distal end being operatively connected to a body interior surface;

a shock absorbing second support inside the body interior, the shock absorbing second support being operatively connected to the satellite receiver, the shock absorbing second support having a length with opposite proximal and distal ends, the shock absorbing second support being moveable between a retracted position of the shock absorbing second support relative to the satellite receiver where the shock absorbing second support distal end is in close proximity to the satellite receiver and an extended position of the shock absorbing second support relative to the satellite receiver where the shock absorbing second support distal end is displaced from the satellite receiver, the shock absorbing second support distal end being operatively connected to the body interior surface; and, the shock absorbing first support and the shock absorbing second support being in their retracted positions relative to the satellite receiver when the body is collapsed to its collapsed configuration and the shock absorbing first support and the shock absorbing second support being in their extended positions relative to the satellite receiver when the body is expanded to its spherical configuration.

9. The satellite antenna of claim 8, further comprising:

a spring device operatively connected to the shock absorbing first support urging the shock absorbing first support toward its extended position relative to the satellite receiver.

10. The satellite antenna of claim 9, further comprising:

the spring device being operatively connected to the shock absorbing second support and urging the shock absorbing second support to its extended position relative to the satellite receiver.

11. The satellite antenna of claim 8, further comprising:

the shock absorbing first support and the shock absorbing second support being coaxial and having a common center axis.

12. The satellite antenna of claim 8, further comprising:

the satellite receiver being rotatable about mutually perpendicular first and second axes inside the body interior.

13. The satellite antenna of claim 8, further comprising:

at least a portion of the body being constructed as wave partially reflecting and wave partially transmitting.

14. The satellite antenna of claim 8, further comprising:

the satellite antenna being air droppable.

15. The satellite antenna of claim 8, further comprising:

a rotation device inside the body interior, the rotation device being operably connected to the satellite receiver and being operable to rotate the satellite receiver about first and second mutually perpendicular axes in the body interior;

the shock absorbing first support being operatively connected to the rotation device; and, the shock absorbing second support being operatively connected to the rotation device.

16. The satellite antenna of claim 8, further comprising:

an energy source inside the body interior, the energy source being operatively connected to the satellite receiver and being operable to supply energy to the satellite receiver;

the shock absorbing first support being operatively connected to the energy source; and, the shock absorbing second support being operatively connected to the energy source.

17. A method of remotely deploying an unmanned satellite antenna comprising:

providing a body with a spherical exterior surface and a spherical interior surface with the spherical interior surface surrounding a body interior;

positioning a satellite receiver inside the body interior;

supporting the satellite receiver inside the body interior with shock absorbing supports that operatively connect the satellite receiver to the body interior surface and allow limited movement of the satellite receiver in the body interior in response to a shock force exerted on a body exterior surface; and, deploying the unmanned satellite antenna at a desired location by air dropping the unmanned satellite antenna at the desired location.

18. The method of claim 17, further comprising:

collapsing the body to a collapsed configuration for transportation of the unmanned satellite antenna; and, expanding the body to a spherical configuration for deployment of the unmanned satellite antenna at the desired location.

19. The method of claim 18, further comprising:

constructing at least a portion of the body as wave partially reflecting and wave partially transmitting.

20. The method of claim 18, further comprising:

rotating the satellite receiver about mutually perpendicular first and second axes inside the body interior when the unmanned satellite antenna is at the desired location.

* * * * *